US012151181B2

(12) United States Patent
Ainley et al.

(10) Patent No.: US 12,151,181 B2
(45) Date of Patent: Nov. 26, 2024

(54) TRANSFORMABLE MODULAR TOY ELEMENT

(71) Applicant: LEGO A/S, Billund (DK)

(72) Inventors: Timothy Mark Ainley, Billund (DK); Troels Hermann, Billund (DK); Jens Peter Haurum, Billund (DK); Steffen Gøtske, Billund (DK)

(73) Assignee: LEGO A/S, Billund (DK)

( * ) Notice: Subject to any disclaimer, the term of this patent is extended or adjusted under 35 U.S.C. 154(b) by 228 days.

(21) Appl. No.: 17/764,631

(22) PCT Filed: Sep. 24, 2020

(86) PCT No.: PCT/EP2020/076693
§ 371 (c)(1),
(2) Date: Mar. 29, 2022

(87) PCT Pub. No.: WO2021/063791
PCT Pub. Date: Apr. 8, 2021

(65) Prior Publication Data

US 2022/0339551 A1 Oct. 27, 2022

(30) Foreign Application Priority Data

Oct. 1, 2019 (DK) ..... PA201970613

(51) Int. Cl.
*A63H 33/08* (2006.01)
*A63H 33/00* (2006.01)
*A63H 33/04* (2006.01)

(52) U.S. Cl.
CPC ..... *A63H 33/003* (2013.01); *A63H 33/042* (2013.01); *A63H 33/086* (2013.01)

(58) Field of Classification Search
CPC .. A63H 33/003; A63H 33/042; A63H 33/086; A63H 33/04

(Continued)

(56) References Cited

U.S. PATENT DOCUMENTS 253,711 A 2/1882 Inman
2,968,121 A * 1/1961 Pearson, Jr. ..... A63H 37/00 403/166

(Continued)

FOREIGN PATENT DOCUMENTS

CN 110062645 A 7/2019
EP 1348474 A2 10/2003

(Continued)

OTHER PUBLICATIONS

CN Office Action in P22J68790A dated Mar. 14, 2023, 6 pages.

(Continued)

*Primary Examiner* — Alexander R Niconovich
(74) *Attorney, Agent, or Firm* — Day Pitney LLP; George Chaclas; Anthony A. Kassas

(57) ABSTRACT

A transformable modular toy element is provided. The transformable modular toy element is for use in a toy construction system comprising a plurality of modular toy elements. The transformable modular toy element comprises a body portion and a head portion. The body portion comprises one or more coupling members, the one or more coupling members being adapted for releasably coupling the body portion with modular toy elements of the toy construction system. The head portion is attached to the body portion. The head portion comprises a cavity for receiving the body portion therein. The body portion is moveable with respect to the head portion between a retracted position where the body portion is retracted into the cavity, whereby the transformable modular toy element has a first shape, and a deployed position where the body portion is in the axial direction deployed from the cavity, whereby the transformable modular toy element has a second shape. The transformable modular toy element further comprises first lock- (Continued)

ing means adapted to lock the body portion in the deployed position.

14 Claims, 4 Drawing Sheets

(58) Field of Classification Search
USPC ..... 446/97, 118, 120, 128
See application file for complete search history.

(56) References Cited

U.S. PATENT DOCUMENTS

| | | | | |
|---|---|---|---|---|
| 3,005,282 | A * | 10/1961 | Christiansen | A63H 33/086 446/128 |
| D253,711 | S | 12/1979 | Christiansen et al. | |
| 5,162,013 | A * | 11/1992 | von Mohr | A63H 3/12 446/183 |
| 5,779,515 | A * | 7/1998 | Chung | A63H 33/04 446/90 |
| 6,443,796 | B1 * | 9/2002 | Shackelford | A63H 33/086 273/237 |
| 7,306,504 | B2 * | 12/2007 | Saucier | A63H 33/003 446/268 |
| D580,994 | S | 11/2008 | Johansson et al. | |
| D588,654 | S | 3/2009 | Sato et al. | |
| 7,785,168 | B2 * | 8/2010 | Yamada | A63H 3/003 446/99 |
| 8,142,252 | B1 * | 3/2012 | Krull | A43B 23/24 446/268 |
| 8,477,931 | B2 * | 7/2013 | Thompson | H04B 1/3888 379/451 |
| 8,517,791 | B2 * | 8/2013 | Yamada | A63H 33/26 446/129 |
| 9,022,832 | B1 * | 5/2015 | Skripps | A63H 3/46 446/376 |
| 9,067,147 | B1 * | 6/2015 | Woodhouse | A63H 3/46 |
| 9,723,113 | B2 * | 8/2017 | Thompson | A45C 11/00 |
| 10,695,687 | B2 * | 6/2020 | Fernandez | A63H 33/003 |
| 10,864,452 | B2 * | 12/2020 | Fernandez | A63H 13/00 |
| 11,219,839 | B2 * | 1/2022 | Fernandez | A63H 33/003 |
| 11,376,515 | B1 * | 7/2022 | Livingston | A63H 3/36 |
| 12,029,993 | B1 * | 7/2024 | Chen | A63H 33/26 |
| 2010/0291831 | A1 | 11/2010 | Yamada | |
| 2012/0309257 | A1 * | 12/2012 | McDonald | A63H 33/003 446/85 |
| 2016/0271509 | A1 * | 9/2016 | Arboleda | A63H 33/086 |
| 2016/0361661 | A1 * | 12/2016 | Tiefel | A63H 3/003 |
| 2017/0232354 | A1 * | 8/2017 | Arboleda | A63H 5/00 446/71 |
| 2017/0274292 | A1 * | 9/2017 | Kanai | A63H 33/08 |
| 2019/0099684 | A1 | 4/2019 | Fernandez et al. | |
| 2022/0410025 | A1 * | 12/2022 | Livingston | A63H 33/26 |

FOREIGN PATENT DOCUMENTS

| | | | |
|---|---|---|---|
| JP | 2013244198 | A2 | 12/2013 |
| JP | 2014069017 | A | 4/2014 |

OTHER PUBLICATIONS

Search Report issued in corresponding Danish patent application No. PA201970613, mailed Feb. 21, 2020, 4 pages.

International Search Report and Written Opinion issued in corresponding international patent application No. PCT/EP2020/076693, mailed Apr. 8, 2021, 9 pages.

* cited by examiner

RETRACTED

TRANSFER

DEPLOYED
UNLOCKED

DEPLOYED
LOCKED

TRANSFORMABLE MODULAR TOY ELEMENT

The present application claims priority to DK Patent Application No. PA201970613 dated Oct. 1, 2019, and is a U.S. national stage application under 35 U.S.C. 371 of co-pending International Application No. PCT/EP2020/076693 filed on Sep. 24, 2020, the contents of each are incorporated by reference herein in their entirety for all purposes.

The present invention relates in one aspect to a transformable modular toy element adapted for use in a toy construction system comprising a plurality of modular toy elements. According to a further aspect, a toy construction system is provided, the toy construction system comprising a transformable modular toy element and one or more further modular toy elements.

BACKGROUND OF THE INVENTION

Modular building blocks for construction play experiences are well-known. For example, toy construction systems comprise such modular toy elements having cooperating coupling members that allow for the releasable interconnection of the modular toy elements in order to construct models, disassemble them, and re-construct modified or entirely new models. A toy construction system comprising modular toy elements is, for example, disclosed in U.S. Pat. No. 3,005,282. Such toy construction systems may also include modular toy elements in the shape of small figurines, or figurine elements, which can be assembled into a large variety of different figurines with moveable elements, in order to facilitate a role playing experience in combination with a building experience. Such figurine elements are, for example, disclosed in U.S. 253,711. The play experiences of such a toy construction system may further be enhanced by the addition of functional elements, such as modular toy elements including electrical and electronic components, such as sensors for receiving input, processors for processing the input, and actuators for generating an output, e.g. directly on the basis of the input, or on the basis of the processed input. Such electronically enhanced toy experiences may facilitate very complex and advanced play experiences. However, such complex and advanced play experiences may not be easily accessible to everybody. Such electronically enhanced toy experiences may further require additional infrastructure, such as wiring and power supplies.

It is therefore desirable to develop further modular toy elements for use in existing toy construction systems so as to enhance the stimulating experience of physical play with such modular toy construction systems in a simple and intuitive manner.

SUMMARY OF THE INVENTION

A first aspect of the invention relates to a transformable modular toy element adapted for use in a toy construction system comprising a plurality of modular toy elements, wherein the transformable modular toy element comprises: a body portion comprising one or more coupling members, the one or more coupling members being adapted for releasably coupling the body portion with modular toy elements of the toy construction system; a head portion attached to the body portion, wherein the head portion comprises a cavity for receiving the body portion therein, wherein the body portion is moveable with respect to the head portion between a retracted position where the body portion is retracted into the cavity, whereby the transformable modular toy element has a first shape, and a deployed position where the body portion is in the axial direction deployed from the cavity, whereby the transformable modular toy element has a second shape; and first locking means adapted to lock the body portion in the deployed position.

The head portion typically defines a housing with a cavity for receiving the body portion therein. The body portion is attached to the head portion in such a manner that the body portion can be retracted into and deployed from the cavity.

Preferably, the body portion and at least some of the one or more coupling members provided thereon are configured such that the transformable modular toy element can be releasably interconnected with other toy construction elements at least when the body portion is in the deployed position, also referred to as the deployed state of the transformable modular toy element. To this end, one or more of the coupling members are arranged on the body portion in such a way that they are accessible when the body portion is in the deployed position. The one or more coupling members are thus arranged such that they are functionally accessible for connecting the transformable modular toy element with other modular toy elements of the toy construction system, at least when the body portion is in the deployed position. Typically, the one or more coupling members are arranged on at least one end of the body portion as seen in an axial direction thereof.

Advantageously according to some embodiments, the body portion and one or more of the coupling members provided thereon are configured such that the transformable modular toy element can be releasably interconnected with other toy construction elements when the body portion is in the retracted position, also referred to as the retracted state of the transformable modular toy element. To this end, one or more of the coupling members are arranged on the body portion in such a way that they are accessible when the body portion is in the retracted position. Typically, the one or more coupling members are arranged on at least one end of the body portion as seen in an axial direction thereof.

Advantageously according to some embodiments, the body portion and one or more of the coupling members provided thereon are configured such that the transformable modular toy element can be releasably interconnected with other toy construction elements both in the retracted state and in the deployed state. To this end, one or more of the coupling members are arranged on the body portion in such a way that they are accessible when the body portion is in the deployed position, and further that they are accessible from the outside of the transformable modular toy element, also when the body portion is in the retracted position. Typically, the one or more coupling members are arranged on at least one end of the body portion as seen in an axial direction thereof.

In the first shape of the transformable modular toy element, the body portion is retracted into the head portion, i.e. at least partially concealed in the corresponding cavity of the head portion. The first shape may also be referred to as the retracted state of the transformable modular toy element. In the second shape of the transformable modular toy element at least a portion of the body projects from the head portion in the axial direction. The second shape may thus also be referred to as the deployed state of the transformable modular toy element. In the second shape, the body portion projects at least further from the head portion than in the first shape. Typically, in the first shape, the body portion is fully retracted into the head portion, and protrudes from the head portion when the transformable modular toy element has assumed the second shape. The second shape is extended in the axial direction as compared to the first shape.

The first and second shapes are conceived as different kinds of shapes associated with different kinds of play experiences. When the transformable modular toy element is in the retracted state it has a first kind of shape enabling a first kind of play experience, such as a marble or dice rolling kind of play experience; whereas when the transformable modular toy element is in the deployed state it has a second kind of shape enabling a second kind of play experience, such as a role playing kind of play experience. Furthermore, since the transformable modular toy element has coupling elements for engaging a releasable coupling with further modular toy elements, a construction play experience is enabled in addition to and in combination with the different play experiences already associated with the two different (first and second) shapes of the transformable modular toy element. A particularly rich and flexible combination of different kinds of play is thus achieved. Thereby, an enhanced creative physical play is facilitated when using the transformable modular toy element in a compatible toy construction system.

By arranging the coupling elements on the body portion, the one or more coupling elements itself can also be made retractable and deployable. Thereby, a further enhanced creative play is facilitated. Fully retracting the coupling elements into the contours of the first shape is useful, for example, where certain features of the coupling elements would otherwise interfere with a play experience associated with the first shape. By suitably arranging the coupling elements on the body portion, the coupling elements can be retracted into the head portion—out of harms' way with respect to the conceived play experience associated with the first shape. Nevertheless, depending on the arrangement, the coupling elements may still be accessible from the outside, also in the retracted state of the transformable modular toy element. It may in this case, however, be necessary to use selected ones of the modular toy elements of the toy construction set in order to facilitate a proper building play experience in combination with a broader range of further modular toy elements of the toy construction system. For that purpose, the selected modular toy elements should be shaped and dimensioned so as to reach from the outside of the first shape in to the coupling element arranged on the body portion. At least a first coupling element on the selected modular toy element is adapted to releasably couple to the coupling element on the body portion, wherein at least a second coupling element is arranged such on the selected modular toy element that it is directly accessible for connection to further modular toy elements of the toy construction system when the selected modular toy element is coupled to the body portion.

For example, protruding studs, recessed flats, or flanges that may be part of cooperating coupling elements in a toy construction system, if arranged on the outer surface of the head portion, may affect a smooth rolling motion as desired for a marble play experience associated with a given first shape. By arranging such studs, flats, or flanges on the body portion, they may be fully retracted into the first shape, e.g. a marble shape as defined by the head portion, and thus allow for a sufficiently smooth rolling motion. Deploying the body portion, on the other hand, makes the coupling elements arranged thereon directly accessible for attachment to further modular toy elements. Thereby, at least in the deployed state, the transformable modular toy can be directly used for construction play in combination with the play experience associated with the deployed state.

The transformable modular toy element further comprises a first locking means adapted to lock the body portion in the deployed position. When in a locked state, the first locking means is adapted to prevent inadvertent activation of the transformation mechanism. Thereby, an improved intuitive handling of the transformable modular toy element is facilitated, in particular during play activities involving a combination of the kind of play associated with the deployed state, such as a role playing experience, and building/construction play.

The particular combination of providing one or more coupling members on the body and providing locking means adapted to lock the body in the deployed position allows for an improved building experience, at least when using the transformable modular toy element for building when it is in the deployed state, as it prevents the inadvertent transformation of the transformable modular toy element from the second shape back to the first shape and/or allows to hold the transformable modular toy element by the head portion and to transfer an adequate force for connecting (or disconnecting) the one or more coupling members of the body portion to (or from) other toy construction elements. In the absence of the first locking means, an unintentional activation of the transformation mechanism might otherwise arise during certain play activities, such as toy construction model building, involving a handling of the transformable modular toy, e.g. in its deployed state.

Advantageously according to some embodiments, the first locking means is adapted to prevent inadvertent activation of the transformation mechanism by forces for engaging or disengaging a coupling of the transformable modular toy element in its deployed state, i.e. when the transformable modular toy element assumes the second shape.

By way of example, during combined role playing and construction play it may be most natural to grip the transformable modular toy element in its deployed state by the head portion, e.g. when moving the transformable modular toy around and when trying to attach/detach the transformable modular toy to/from other modular toy elements. When unlocked, the forces applied during building operations for engaging (or disengaging) a coupling between the transformable modular toy element and further modular toy elements may unintentionally activate the transformation mechanism and cause the body portion to at least partially yield from the deployed position into the head portion, towards the retracted position. This may lead to an undesired transformation, or even completely prevent any useful construction play, since the required forces for engaging (or disengaging) a coupling between the body portion and further modular toy elements cannot easily be transferred from the head portion to the body portion.

By employing the first locking means, the user may lock the transformable modular toy in the deployed state, thereby actively choosing the play experience associated with the second shape, which is then easily combinable with a construction play experience without any undesired diversion into the play experience of the first shape. The user may unlock the transformable modular toy to allow for transformation between the second shape and the first shape, thereby actively choosing the desired play experience by selecting the associated shape of the transformable modular toy. Thereby, the user is empowered to actively selecting the desired combination of play experiences.

Alternatively or in addition to the first locking means, second locking means may be provided, wherein the second locking means are adapted to lock the body in the retracted position. When activated, the second locking means is adapted to prevent inadvertent activation of the transformation mechanism, e.g. by forces for disengaging a coupling of the transformable modular toy element in its retracted state, from modular toy elements of the toy construction system. Thereby, a further improved intuitive handling of the transformable modular toy element is facilitated, in particular during play activities involving a combination of the kind of play associated with the retracted state, such as a marble rolling experience, and building/construction play. Furthermore, a deliberate user gesture is thereby required in order to facilitate a transformation from the retracted state into the deployed state, thus further enhancing the empowerment of the user to actively select the desired combination of play experiences.

Further according to some embodiments of the transformable modular toy element, the locking means is adapted to prevent the body portion from being moved from the deployed position towards the retracted position by an axially directed compressive force applied to the transformable modular toy element.

The locking means is thus adapted to lock the transformable modular toy element in the deployed state so as to prevent the body portion from being moved from the deployed position towards the retracted position in the corresponding cavity of the head portion by an axially directed compressive force applied to the transformable modular toy element, i.e. by a force pushing the head portion and body portion towards each other in the axial direction. Thereby, an inadvertent activation of a mechanism for transforming the transformable modular toy element by axially oriented forces is prevented, which could e.g. arise during building with the transformable modular toy element in the second shape (e.g. the deployed state representing a figurine), when holding the transformable modular toy by the head portion and via the head portion applying an axially oriented force to the body portion against a support surface, e.g. when interconnecting the body with other modular toy elements of the toy construction system. Such an embodiment thus facilitates a natural building/construction gesture by gripping the transformable modular toy element by the larger head portion and, via the head portion, to apply the required engagement forces for engaging the coupling members on the body portion with coupling members of a further modular toy element of the toy construction system. This embodiment is particularly advantageous, when engaging cooperating coupling members of modular toy elements the toy construction system involves compression forces applied in an axial direction. By activating the locking means, which in their "LOCKED" position are configured to prevent the deployed body portion from yielding back into the cavity of the head portion under the effect of axial forces, it becomes possible to apply the required engagement force for coupling the transformable modular toy element and further modular toy elements together.

Advantageously according to some embodiments, the locking mechanism is adapted to prevent activation of an axial transformation mechanism when applying an axial oriented compressing force at least up to and including an axial force required for coupling the transformable modular toy element to a further modular toy element of the toy construction system. A compressive force is a force pushing the body portion towards the retracted position in the cavity of the head portion. In a toy construction system using friction engagement type coupling members, such as the known stud and cavity type coupling members, the axial force required for coupling the transformable modular toy element to a further modular toy element of the toy construction system may be determined to correspond to the opposite of a coupling force characterizing said friction engagement type. The coupling force may be determined as a force required for releasing an engagement between the coupling members of interconnected modular toy elements.

Advantageously according to some embodiments, the body portion is elongated in the axial direction, i.e. an axial dimension of the body as measured in the axial direction is larger than any one of transverse dimensions of the body as measured in transverse directions perpendicular to the axial direction.

Advantageously according to some embodiments, the first shape is defined by an envelope to the head portion. According to this embodiment, the body portion is fully received within the corresponding cavity in the head portion, and thus does not protrude from the head portion, when the body portion is in the retracted position.

Advantageously according to some embodiments, the first shape is defined by a convex envelope to the head portion, i.e. by an enveloping surface connecting the outermost points and surface elements of the head portion without concave surface portions as seen from the outside of the enveloping surface.

Further according to some embodiments of the transformable modular toy element, the first shape is one of a sphere, a spheroid, an ellipsoid, and a polyhedron, such as a regular polyhedron. Preferably, the first shape is a spherical shape. Further according to some embodiments, the first shape is a spheroidal shape or an ellipsoidal shape. The first shape may be an approximation of a sphere or spheroid. For example, a sphere or spheroid can be approximated by a three-dimensional body with a surface spanned by points defining a sphere or spheroid, wherein a centre of the sphere or spheroid lies within a convex envelope to the three-dimensional body defined by these points. While the shape may be described as generally spherical, spheroidal, or ellipsoidal, an approximation to these shapes may comprise voids, such as openings in the surface, concave portions, or essentially flat surface portions, as seen from outside the shape.

Depending on the details of the first shape the transformable modular toy element may be adapted for different kinds of play experiences, such as marble rolling or dice rolling. When the first shape is spherical, spheroidal, or ellipsoidal; or when the first shape is close to spherical, spheroidal, or ellipsoidal; or when a large number of evenly distributed shape defining points ensure a good approximation of such a spherical, spheroidal, or ellipsoidal shape, the first shape will be adapted for marble rolling, and may thus facilitate a marble play experience. When the spherical, spheroidal, or ellipsoidal shape is defined by fewer defining points that can be attributed to a common spherical, spheroidal or ellipsoidal surface, and when these defining points span flat surfaces elements for supporting the transformable modular toy element in the first shape thereon, the first shape may facilitate a dice-rolling play experience. In particular, a dice-rolling experience may be facilitated by a polyhedral shape, such as a regular polyhedral shape, such as a regular polyhedron with outermost points lying on a sphere or spheroid and spanning a number of flat surface elements for supporting the transformable modular toy element thereon in different orientations when the transformable modular toy element is in the first shape. For example, the first shape may be a regular polyhedron with 4, 6, 8, 12, or 20 flat surface elements. Typically for a marble or dice rolling play experience, the transformable modular toy element is designed such that the centre of mass of the transformable modular toy element in the first shape is at the centre of the spherical, spheroidal, ellipsoidal, or polyhedral shape. However, a location of the centre of mass that is deliberately shifted with respect to the geometric centre of the first shape of the transformable modular toy element is also conceivable, e.g. for the purpose of providing an unusual rolling motion pattern that adds an element of surprise to the play experience.

Depending on the details of the first shape the transformable modular toy element may thus be adapted for marble rolling when the body portion is in the retracted position, or may alternatively be adapted for dice-throwing when the body portion is in the retracted position.

Further according to some embodiments of the transformable modular toy element, the second shape is a figurine shape. The figurine shape may resemble a human, humanoid, robot, droid, or a fantasy being. The figurine like shape may further be configured for representing a character, such as a human or humanoid character, a game character, a character of a story, or any fantasy character. The figurine may also represent an animal, toy-pet, animal-like being, or any fantasy creature. By transforming the transformable modular toy element into a figurine shape, a role playing experience is facilitated in combination with the building experience facilitated by the coupling elements arranged on the body portion, in particular coupling elements arranged on an axial end of the body portion. Thereby, the transformable modular toy element further facilitates a combined role and scene building play experience.

Advantageously according to some embodiments, locking the second shape requires a deliberate locking gesture, wherein the locking gesture is distinct from a transformation gesture. Typically, the locking gesture is applied after transformation from the first shape into the second shape, i.e. the first locking means are typically engaged after the transformable modular toy element has been moved from the deployed position to the retracted position by a user-applied transformation gesture for retraction of the body portion into the head portion. Further advantageously, unlocking the second shape, i.e. disengaging the locking means, requires a deliberate unlocking gesture, wherein the unlocking gesture is distinct from a transformation gesture. Typically, the unlocking gesture is applied prior to transformation from the second shape into the first shape, i.e. the first locking means are typically disengaged before the transformable modular toy element is moved from the retracted position to the deployed position by a user-applied transformation gesture for deployment of the body portion from the head portion. The term "gesture" as employed herein refers to user activated movement of the body portion with respect to the head portion and/or user activation of a physical user interface mechanism of the transformable modular toy element.

Advantageously, the transformation trajectory of the body comprises an intermediate position between the retracted position and a deployed and locked position, wherein a first segment of the transformation trajectory defines a first gesture for moving the body between the retracted position and the intermediate position, and wherein a second segment of the transformation trajectory defines a second gesture distinct from the first gesture for moving the body between the intermediate position and the deployed and locked position. Advantageously the first gesture is a linearly sliding movement, such as in an axial direction; further advantageously the second gesture is a rotational movement, such as a rotation around an axis of rotation parallel to the axial direction. Advantageously, the axis of rotation passes through the centre of the head portion. Advantageously according to some embodiments, the body portion is kept in the LOCKED position by a snap fit engagement. Further advantageously, the deployed position has a first state (UNLOCKED) and a second state (LOCKED): in the UNLOCKED state of the deployed position the body is directly moveable from the deployed position to the retracted position; whereas in the LOCKED state of the deployed position the body portion cannot directly be moved from the deployed state to the retracted state, but requires two distinct gestures from a user moving the body portion along a trajectory with at least two-segments. At least a first segment is for bringing the body portion from the LOCKED state to the UNLOCKED state, and at least a second segment is for bringing the body from the UNLOCKED state of the deployed position to the retracted position. The locking means are thus adapted to prevent retracting the body, i.e. moving the body from the deployed to the retracted position, by a single movement. A locking effect of the locking means may thus be brought about by an appropriate shaping and segmentation of the transformation trajectory.

Further according to some embodiments, the transformable modular toy element further comprises cooperating guide elements defining a trajectory for a sliding movement of the body portion with respect to the head portion between the retracted position and the deployed position. A sliding guided movement allows for a simple transformation mechanism.

Further according to some embodiments of the transformable modular toy element, the cooperating guide elements comprise one or more guide channels defined in one of the head portion and the body portion, and one or more cooperating projections defined on the other one of the head portion and the body portion. Cooperating guide channels and projections ensure a simple and reliable sliding movement of the body portion with respect to the head portion.

Further according to some embodiments of the transformable modular toy element, the trajectory comprises an axial segment defining a translational movement of the body portion with respect to the head portion in the axial direction. As already discussed above, distinct gestures for transformation and for operation of the locking means may be defined by corresponding trajectory segments. A linear translational movement along the axial direction allows for a simple and intuitive deployment and retraction mechanism that can be activated in a simple and intuitive manner, e.g. by a pushing gesture applied to either axial end of the body portion. Thereby, a particularly simple and intuitive handling of the transformable modular toy element is achieved. Preferably, the axial segment starts at the retracted position.

Further according to some embodiments of the transformable modular toy element, the trajectory further comprises a rotational segment defining a rotational movement of the body portion with respect to the head portion, around an axially oriented axis. By providing a guided rotational movement around an axially oriented axis of rotation, which is confined to a trajectory by suitable guiding means, a locking effect against axial displacement of the body portion with respect to the head portion can be achieved. In particular, movements of the body portion under the effect of forces applied in an axial direction transverse of the trajectory are impeded. Thereby, inadvertent movements of retraction and/or deployment, e.g. due to forces applied when handling the transformable modular toy element during role playing or construction play, can be prevented by a rotational gesture applied to the transformable modular toy element.

Further according to some embodiments of the transformable modular toy element, the axial and rotational segments are arranged in sequence to each other, wherein the axial segment connects the retracted position with an unlocked-deployed position, and wherein the rotational segment connects the unlocked-deployed position with a locked-deployed position. Thereby, a particularly intuitive configuration is achieved that is well suited for a playing context, where activities of rolling, role-playing and construction paly are to be combined in the same play experience. A deployment may thus be performed by applying a first gesture of pressing out the body portion from the head portion, and subsequently a second gesture of twisting the body portion with respect to the head portion to lock the transformable modular toy in the second shape. A retraction may then be enacted by applying the corresponding gestures in reverse order, i.e. applying a twisting gesture to unlock the body portion and subsequently pushing the body portion into the retracted position to obtain the first shape.

Advantageously, deployment and retraction occurs in a translational movement in the axial direction, whereas locking and unlocking occurs by a rotational movement, thus requiring two distinct gestures for deployment/retraction and for locking/unlocking, respectively. By clearly separating the activation of the different functions 'transformation' and 'locking' into separate, yet simple gestures, the intuitive handling of the transformable modular toy element is improved.

Further according to some embodiments, the transformable modular toy element further comprises a first snap-fit device adapted to releasably keeping the body portion in a deployed and locked position. By providing such a releasable snap-fit device, a deliberate physical interaction gesture overcoming the barrier of the first snap-fit device is required when unlocking the transformable modular toy before its transformation from the second shape to the first shape. This prevents inadvertent unlocking of the locking means when the body portion is in the deployed and locked position. Advantageously according to some embodiments, the first snap-fit device is arranged such that it is engaged when the body portion is in in a position in the rotational segment of the guiding means trajectory. The snap-fit device thus allows for keeping the locking means engaged in a simple and intuitive manner.

Further according to some embodiments, the transformable modular toy element further comprises a second snap-fit device adapted to releasably keeping the body portion in the retracted position. A transformation from first shape to second shape thus requires a deliberate physical interaction gesture overcoming the snap fit barrier. Thereby, it can be prevented that an inadvertent deployment of the body portion occurs, such as a "falling out" of the body from its retracted position. A snap barrier to be overcome in order to release the second snap-fit device from an engaged state in the retracted position may be configured in relation to the above-mentioned coupling forces. Thereby, a second locking means may be implemented by the second snap-fit device.

Further according to some embodiments of the transformable modular toy element, the one or more coupling members is of the friction engagement type, such as of the stud and cavity type.

Further according to some embodiments of the transformable modular toy element, the one or more coupling members is arranged at a distal end of the body portion as seen in the axial direction thereof, most preferably at the protruding distal end when the body portion is in the deployed position.

According to a further aspect, a toy construction system comprises: a transformable modular toy element and one or more further modular toy elements, each comprising one or more coupling members configured for releasably interconnecting the modular toy elements with each other.

The transformable modular toy element is particularly useful for use in (and as part of) a toy construction system comprising a plurality of modular toy elements, each comprising one or more coupling members configured for releasably interconnecting the modular toy elements with each other, wherein the one or more coupling members of the transformable modular toy element is compatible with corresponding cooperating coupling members of the other modular toy elements in the toy construction system.

Thereby an advanced building experience is facilitated, where the transformable modular toy element can be added to a complex toy construction model constructed from a plurality of modular toy elements, thereby enhancing the functionality of the toy construction model, and thus providing, or at least improving, an engaging play experience. The modular toy elements may be of a known type, such as modular toy elements using a friction type clamping engagement, e.g. of the above-mentioned stud and cavity type. The further modular toy elements of the toy construction system may typically comprise non-transformable modular toy elements. Furthermore, a toy construction system may comprise a plurality of any such transformable modular toy elements as disclosed herein, such as two, three, four, or more transformable modular toy elements. A toy construction model constructed from the toy construction system may thus be enhanced by adding a plurality of transformable modular toy elements to the toy construction model.

BRIEF DESCRIPTION OF THE DRAWINGS

Preferred embodiments of the invention will be described in more detail in connection with the appended drawings, which show in FIG. 1-3 prior art modular toy elements.

DETAILED DESCRIPTION

Various aspects and embodiments of transformable modular toy elements and toy construction systems comprising such transformable modular toy elements as disclosed herein will now be described with reference to modular toy elements in the form of bricks. However, the invention may be applied to other forms of modular toy elements for use in toy construction sets.

Figure 1:
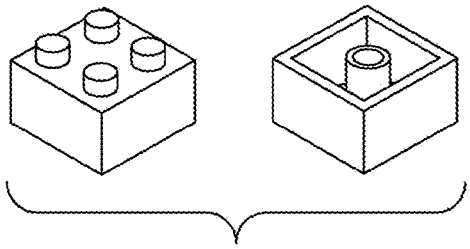
PRIOR ART FIG. 1
Figure 2:
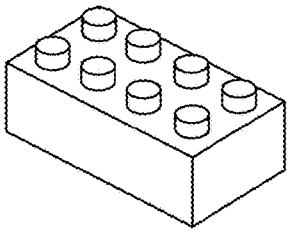
PRIOR ART FIG. 2
Figure 3:
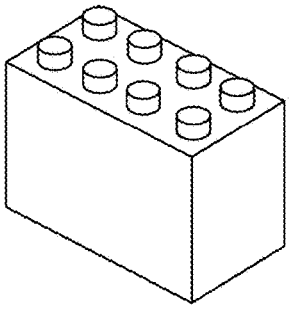
PRIOR ART FIG. 3

FIG. 1 shows a modular toy element with coupling studs on its top surface and a cavity extending into the brick from the bottom. The cavity has a central tube, and coupling studs on another brick can be received in the cavity in a frictional engagement as disclosed in U.S. Pat. No. 3,005,282. FIGS. 2 and 3 show other such prior art modular toy elements. The modular toy elements shown in the remaining figures have this known type of coupling members in the form of cooperating studs and cavities. However, other types of coupling members may also be used in addition to or instead of the studs and cavities. The coupling studs are arranged in a square planar grid, i.e. defining orthogonal directions along which sequences of coupling studs are arranged. The distance between neighbouring coupling studs is uniform and equal in both directions. This or similar arrangements of coupling members at coupling locations defining a regular planar grid allow the modular toy elements to be interconnected in a discrete number of positions and orientations relative to each other, in particular at right angles with respect to each other. The modular toy elements shown here, in FIGS. 1-3, are of the passive type, without additional functionality beyond mechanical model building, such as electromagnetic, electronic, optical, or the like. However, functional modular toy elements may also be combined with embodiments of the present invention. Such functional modular toy elements may in addition to coupling elements for implementing a mechanical model building functionality further include sensors and/or actuators for implementing additional functionality, such as for electromagnetic, electronic and/or optical functions.

Referring to FIGS. 4-7 a first embodiment of a transformable modular toy element is now described. Throughout FIGS. 4-7 the transformable modular toy element is shown in an axial cross-sectional view with the cross-section taken in a central plane comprising a central axis of the transformable modular toy element in the axial direction. The transformable modular toy element has a body portion 10 with coupling members 11 and 12, a head portion 20 with an internal cavity 21 adapted to receive the body portion 10 therein. Coupling members 11, here of the cavity type, are arranged at a bottom end of the body portion 10 as seen in an axial direction. The corresponding coupling members 12, here of the stud type, are arranged on a top end of the of the body portion 10 as seen in the axial direction. The transformable modular toy element 1 further comprises locking means formed by cooperating recesses 31 and protrusions 32 as schematically indicated on FIGS. 4-7, wherein recesses 31 may be arranged on the body portion 10 (as shown in the figures) or on an inside surface of the cavity 21 in the head portion 20 (configuration not shown here), and wherein the cooperating protrusions 32 may correspondingly be arranged on an inside surface of the cavity 21 in the head portion 20 (as shown in the figures) or on the body portion 10 (configuration not shown here).

Figure 4:
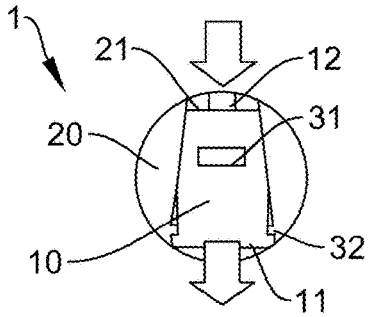
FIG. 4 a cross-sectional view of a transformable modular toy element according to one embodiment.

FIG. 4 shows the transformable modular toy element 1. The body portion 10 is seen in a retracted position with respect to the head portion 20, where the body portion 10 is essentially fully received within the cavity 21. The transformable modular toy element 1 thus assumes a first shape, which here is essentially defined by the spherical shape of the head portion 20. In the first shape the transformable modular toy element 1 is thus adapted for e.g. a marble-type play experience, such as in a marble tossing game or in a marble run. As indicated by the bold arrows in FIG. 4, an axial force can be applied to the body portion 10 in order to move the body portion 10 out of its retracted position in the cavity 21, so as to deploy it from the head portion 20.

Figure 5:
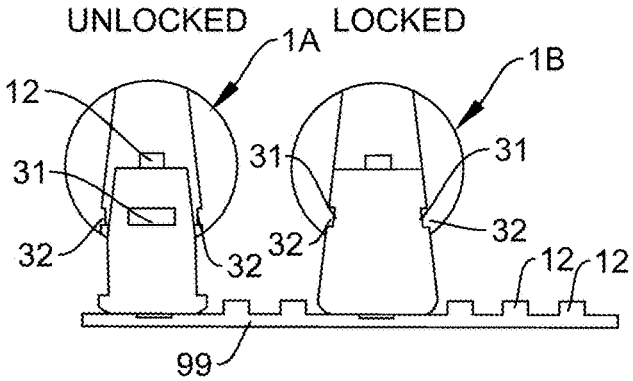
FIG. 5 a cross-sectional view of a set of two transformable modular toy elements according to the embodiment shown in FIG. 1 and a further modular toy element.
Figure 6:
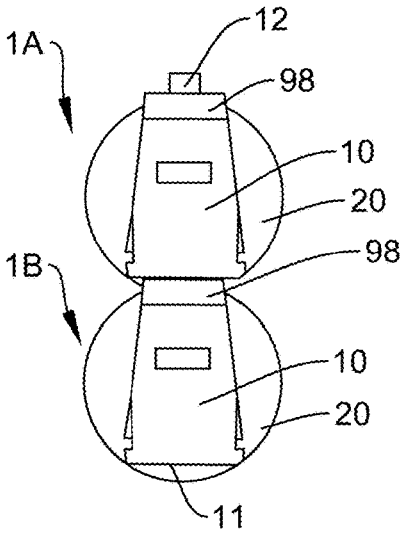
FIG. 6 a cross-sectional view of a set of two transformable modular toy elements according to the embodiment shown in FIG. 1 and two further modular toy elements.
Figure 7:
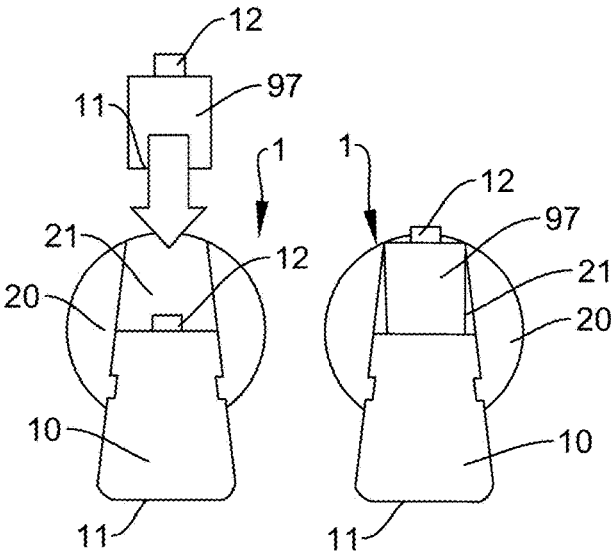
FIG. 7 a cross-sectional view of a set of a transformable modular toy element according to the embodiment shown in FIG. 1 and a further modular toy element.

FIG. 5 shows elements of a toy construction system including a plurality of transformable modular toy elements 1A, 1B, and a building plate as a further modular toy element 99. The body portions 10 of the transformable modular toy elements 1A, 1B are seen in a deployed position with respect to the respective head portion 20, where the body portion 10 projects in an axial direction from the head portion 20. The transformable modular toy elements 1*a*, 1B thus assume a second shape, which is defined by the spherical shape of the head portion 20 and the axially protruding body portion 10. Here, the second shape has a figurine shape which may be used e.g. as a character in a scene build from further modular toy elements, or as a pawn for a board game, where even also the playing board may be constructed from such further modular toy elements of the toy construction system. In the second shape the transformable modular toy elements 1A, 1B, (or 1) is thus adapted for e.g. a role playing and/or a game playing experience.

The transformable modular toy element 1A is shown in an UNLOCKED state where the cooperating recesses 31 and protrusions 32 of the locking means are rotationally misaligned with respect to each other. The locking means of the transformable modular toy element 1A are therefore not engaged. The transformable modular toy element 1B, on the other hand, is shown in a LOCKED state where the body portion 10 in the deployed position has been twisted with respect to the head portion 20 around a central, axially oriented axis of rotation so as to align the cooperating recesses 31 and protrusions 32 of the locking means with respect to each other. The locking means of the transformable modular toy element 1B are thus engaged. Since the transformable modular toy element 1A is in the UNLOCKED state, the body portion 10 will yield into the cavity 21 under the application of an axially compressive force. This may e.g. arise as an undesired issue when a user grips the transformable modular toy element 1A by its head portion 20 in order to attach it to the building plate 99. Owing to the engaged locking means 1B, on the other hand, does not yield back into the head portion when handled in this way.

Figure 8:
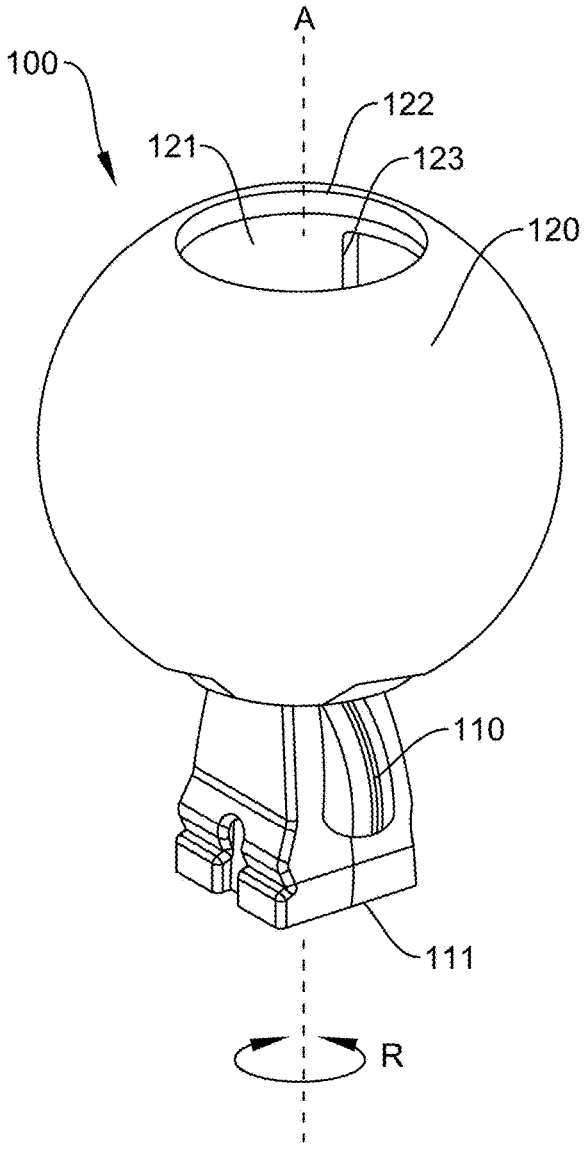
FIG. 8 a perspective view of a transformable modular toy element according to a further embodiment.
Figure 9:
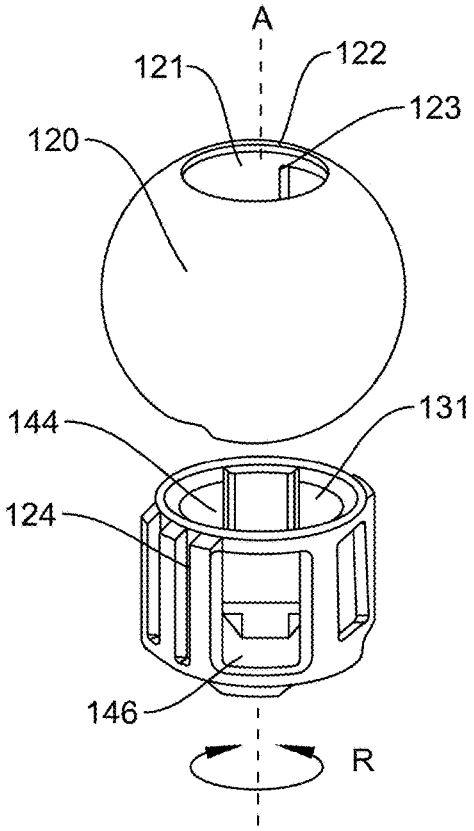
FIG. 9 a perspective exploded view of components of a head portion of the transformable modular toy element shown in FIG. 8.
Figure 10:
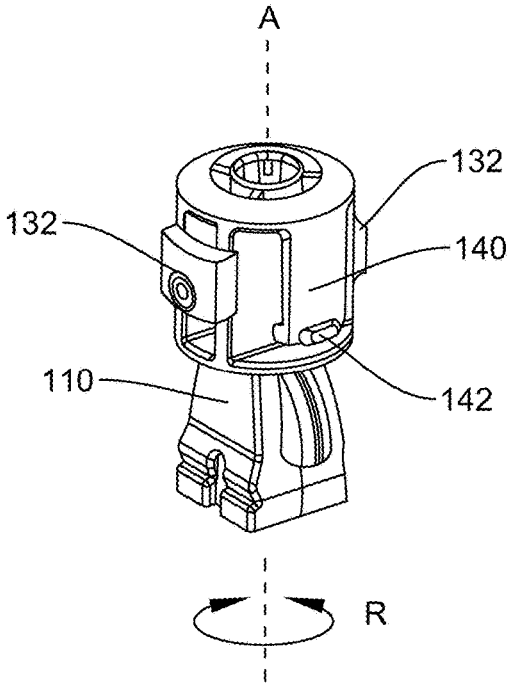
FIG. 10 a perspective view of a body portion of the transformable modular toy element shown in FIG. 8.

Referring to FIGS. 8-10, a second embodiment of a transformable modular toy element 100 is now described. The transformable modular toy element 100 has a body portion 110, which at a bottom end of it as seen in an axial direction A has a coupling member 111 in the form of a cavity adapted for receiving cooperating coupling members in the shape of studs in a known manner and as already discussed above. The body portion 110 resembles at a lower part thereof a humanoid body having a torso, legs, and arms, as best seen in FIG. 10. The transformable modular toy element 100 has furthermore a spherical head portion 120 with a cavity 121 adapted for receiving the body portion 110 therein. The body portion 110 is attached to the head portion 120 and can be moved with respect to the head portion 120 between a retracted position and a deployed position. As best seen in FIG. 9, the head portion 120 comprises an outer shell 122 with an outer surface defining a spherical shape, an inner shell 123 essentially forming the bulk of the head portion, and a frame 124. The frame 124 has inner guide surfaces 131 adapted to guide the transformation movement of the body portion 110 with respect the head portion 120 by interaction with guide members 132 as detailed further below with respect to FIGS. 11*a/b*-14*a/b*. Furthermore, the frame 124 has members 144, 146 adapted to cooperate with members 142 arranged on the distal end of flexible arms 140 to provide first and second snap-fit devices as also detailed further below with respect to FIGS. 11*a/b*-14*a/b*.

Figure 11A:
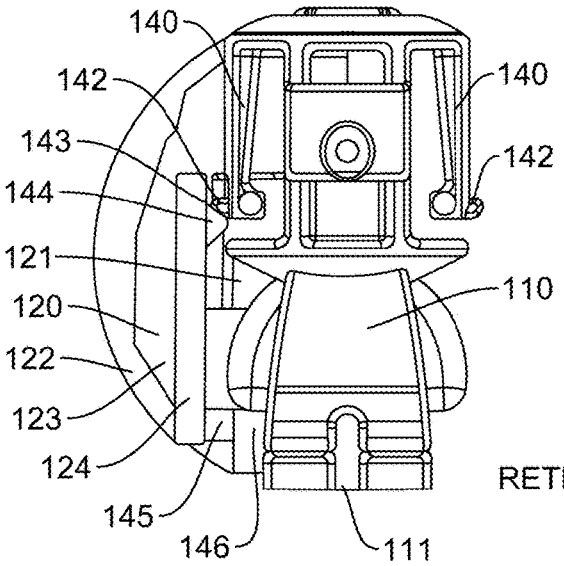
FIG. 11*a/b* first and second elevational views of the transformable modular toy element shown in FIG. 8 with the head portion partially cut away, in a RETRACTED state.
Figure 11B:
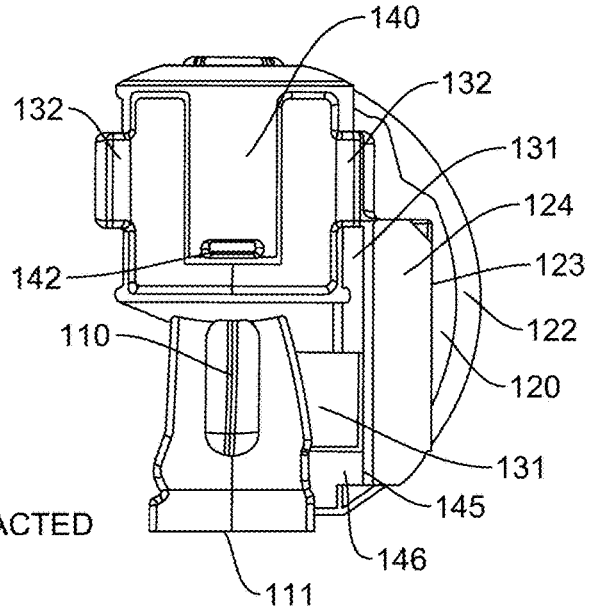

Turning now to FIGS. 11*a/b*-14*a/b*, a transformation of the second embodiment of the transformable modular toy element 100 from the first shape into the second shape is described. FIGS. 11*a/b*-14*a/b* show a series of elevational views of the body portion 110 in different positions with respect to the head portion 120, wherein the head portion 120 is partially cut away with two axial cut planes intersecting at an angle of 90 degrees at the central axis A (shown in FIGS. 8-10) to leave a quarter of the head portion 120. In each of the FIGS. 11*a/b*-14*a/b*, the drawings denoted "a" and the drawings denoted "b" show the elevational views of the head portion 120 as seen in these two cut-planes, respectively.

The first shape is a spherical shape adapted for marble or ball type play experiences, whereas the second shape is a figurine shape adapted for e.g. role playing or game playing. The figurine shape may e.g. be a generic pawn or represent a given game character. Just like in the first embodiment shown in FIGS. 4-7, the coupling elements 111 of the body portion 110 are accessible from outside the second embodiment of the transformable modular toy element 100 in any position of the body portion 110 with respect to the head portion 120. The second embodiment of the transformable modular toy element 100 thus also supports building experiences in both the first and second shapes thereof.

Figure 12A:
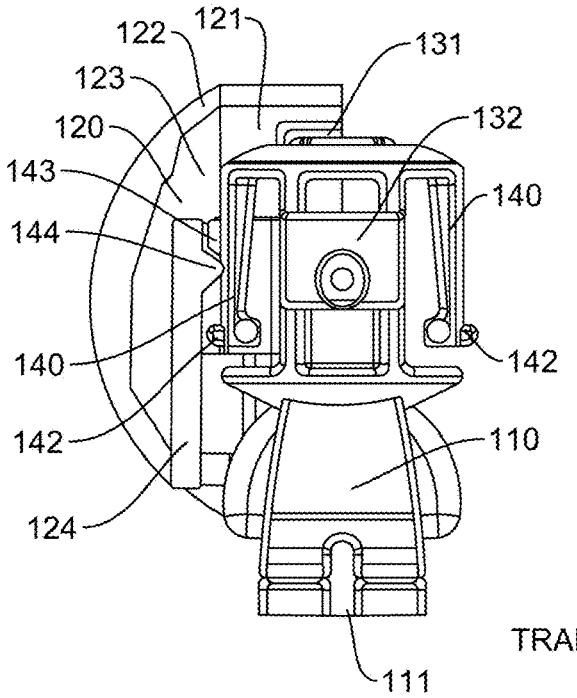
FIG. 12*a/b* first and second elevational views of the transformable modular toy element shown in FIG. 8 with the head portion partially cut away, in a TRANSFER state.
Figure 12B:
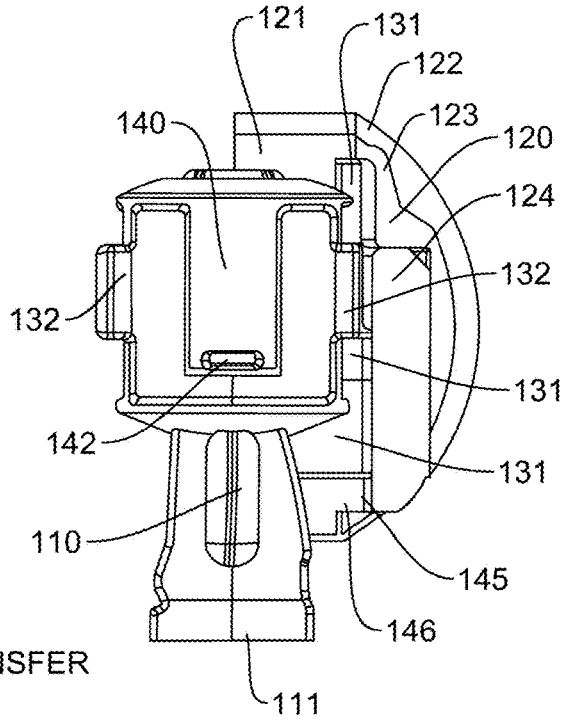
Figure 13A:
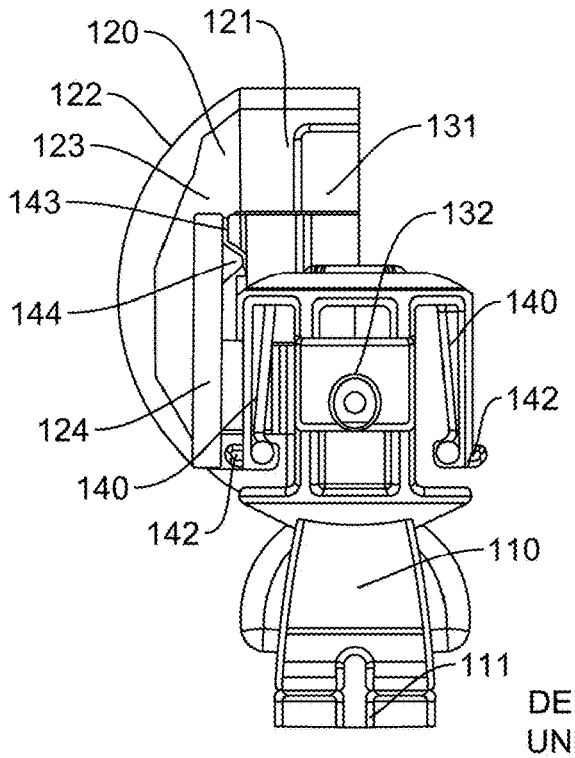
FIG. 13*a/b* first and second elevational views of the transformable modular toy element shown in FIG. 8 with the head portion partially cut away, in a fully DEPLOYED and UNLOCKED state; and in FIG. 14*a/b* first and second elevational views of the transformable modular toy element shown in FIG. 8 with the head portion partially cut away, in a fully DEPLOYED and LOCKED state.
Figure 13B:
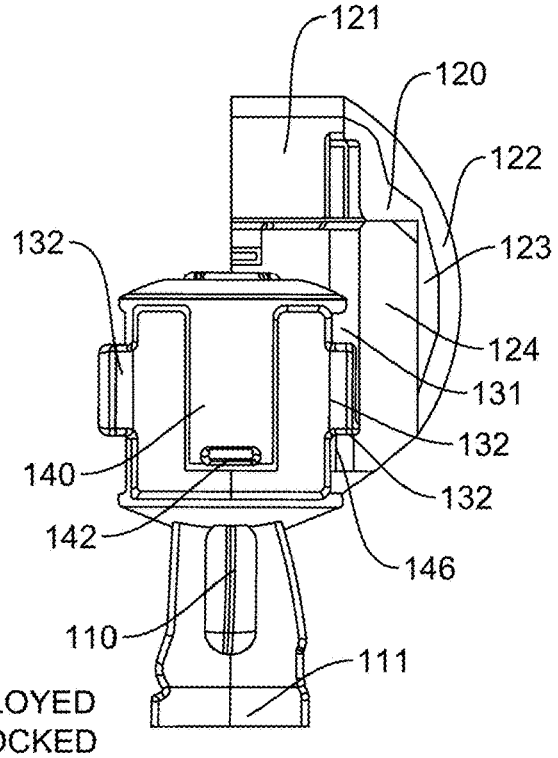
Figure 14A:
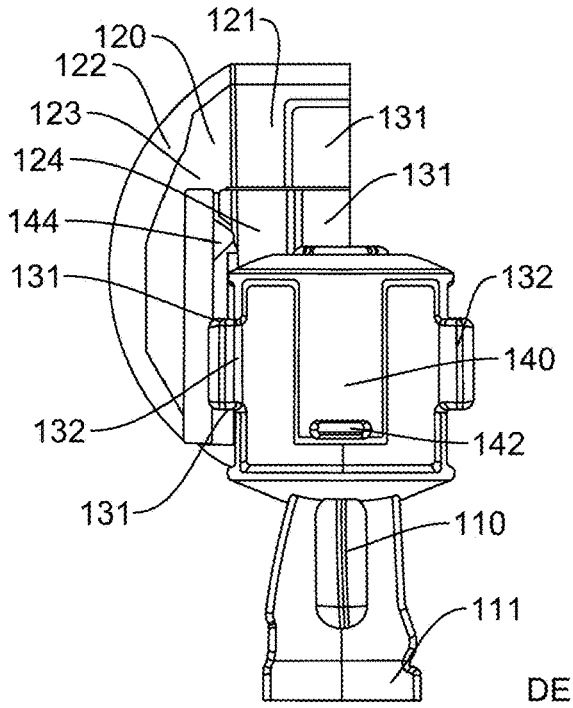

FIGS. 11*a/b* show the body portion 110 in the retracted position where the body portion 110 is essentially fully received within the cavity 121 in the head portion 120. Radially protruding noses 132 of the body portion 110 and guide channels 131 of the head portion 120 interact in this position to prevent radial rotation of the body portion 110 while allowing linear translation in the axial direction with respect to the head portion 120. Radially projecting lugs 142 on distal ends of flexible arms 140 seat in a recess 143 and are held in place against member 144 preventing such axial translational in a snap-fit engagement, thus forming the above-mentioned second snap-fit device for keeping the body portion 110 in the retracted position. A deliberate user gesture applying an axial force to the body portion 110 for overcoming the snap-fit barrier is thus required to linearly move the body portion 110 in the axial direction with respect to the head portion 120 in order to transfer the transformable modular toy element 100 from the first shape into a different shape. FIGS. 12*a/b* show the body portion 110 in a transfer position where the body portion 110 freely translates in the axial direction with respect to the head portion 120 as guided by the cooperating protrusions 132 and guide channels 131 along a first segment of the transformation trajectory defined thereby. The body portion may thus be transferred from the retracted position shown in FIGS. 11*a/b* by an axial movement as shown in FIGS. 12*a/b* along the first segment to a first deployed position where the transformable modular toy element 100 is in a DEPLOYED and UNLOCKED state as shown in FIGS. 13*a/b*. As best seen in FIG. 13*b*, a radially inward projecting rim 146 on the head portion 120 interacts with a bottom surface of the protrusions 132 to limit the axial movement of the body portion with respect to the head portion, thereby preventing the body portion 110 from getting detached from the head portion 120. The guide channels 131 further comprise a rotational segment, which in combination with the protrusions 132 define a rotational movement of the body portion 110 with respect to the head portion 120, around the axially oriented central axis A. By rotating the body portion 110 in the deployed position with respect to the head portion 120 around axis A, the transformable modular toy element 100 is brought from the DEPLOYED and UNLOCKED state as shown in FIGS. 13*a/b* into a DEPLOYED and LOCKED state as shown in FIGS. 14*a/b*. The axial and rotational segments of the trajectory as defined for the guide members 132 running in the guide channels 131 are arranged in sequence to each other, wherein the axial segment connects the retracted position of the body portion 110 with an unlocked-deployed position thereof, and wherein the rotational segment connects the unlocked-deployed position with a locked-deployed position thereof.

Figure 14B:
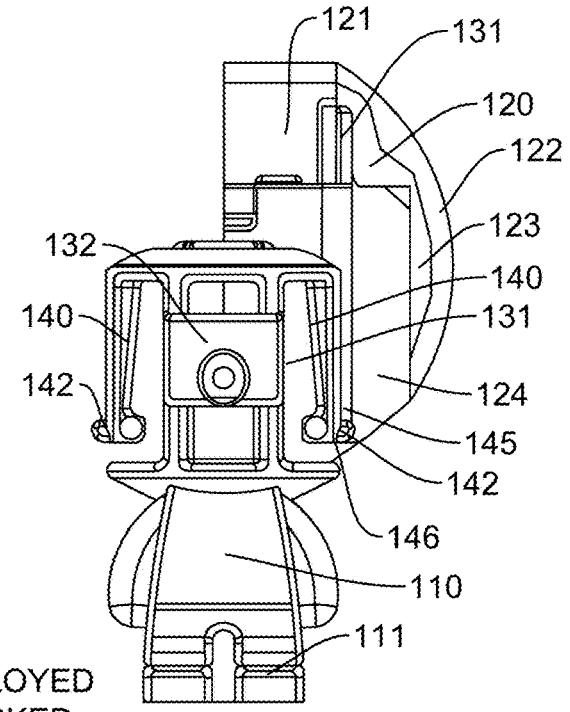

The rim 146 comprises recesses 145, which are shaped and dimensioned to receive the radially protruding lugs 142 when the body portion 110 is in the deployed position, to form a snap-fit engagement against the barrier of the rim 146. As best seen in FIG. 14*b*, by engaging the snap-fit, the body portion may be maintained in a deployed and locked position, thus implementing the above-mentioned first snap-fit device.

The transformable modular toy element 100 can thus be transformed between a spherical shape (also referred to as marble or ball shaped) mainly defined by the head portion 120, and a figurine shape (also referred to as character), as defined by the body portion 110 and the head portion 120 in combination, by retraction/deployment of the body portion 110 with respect to the head portion 120. In particular the deployed state of the transformable modular toy element is lockable to allow for an unperturbed building and/or role or game playing experience when using the figurine.

The invention claimed is:

1. A transformable modular toy element for use in a toy construction system comprising a plurality of modular toy elements, wherein the transformable modular toy element comprises:

a body portion comprising one or more coupling members, the one or more coupling members being configured for releasably coupling the body portion with the plurality of modular toy elements of the toy construction system; and a head portion attached to the body portion, the head portion comprising a cavity for receiving the body portion therein, wherein:

the body portion is moveable with respect to the head portion between a retracted position, wherein the body portion is retracted into the cavity, and a deployed position, wherein the body portion is deployed from the cavity, the transformable modular toy element is configured to have a first or a second shape based on the retracted position and deployed position respectively, the second shape extended in an axial direction relative to the first shape, the body portion is configured to lock relative to the head portion in the deployed position, and the transformable modular toy element further comprising cooperating guide elements defining a trajectory for a sliding movement of the body portion with respect to the head portion between the retracted position and the deployed position, the trajectory having a rotational segment defining rotational movement of the body portion with respect to the head portion around an axially oriented axis.

2. The transformable modular toy element according to claim 1, wherein the body portion is configured to lock in the deployed position, preventing the body portion from being moved to the retracted position by an axially directed compressive force applied to the transformable modular toy element.

3. The transformable modular toy element according to claim 1, wherein the first shape is selected from the group consisting of: a sphere, a spheroid, an ellipsoid, and a polyhedron.

4. The transformable modular toy element according to claim 1, wherein the second shape is a figurine shape.

5. The transformable modular toy element according to claim 1, wherein the cooperating guide elements comprise one or more guide channels defined in one of the head portion or the body portion, and one or more cooperating projections defined on the other one of the head portion or the body portion.

6. The transformable modular toy element according to claim 1, wherein the trajectory further comprises an axial segment defining translational movement of the body portion with respect to the head portion in the axial direction.

7. The transformable modular toy element according to claim 1, wherein:

the deployed position includes an unlocked-deployed position and a locked-deployed position, the trajectory further comprises axial and rotational segments arranged in sequence to each other, and the axial segment connects the retracted position with the unlocked-deployed position, and the rotational segment connects the unlocked-deployed position with the locked-deployed position.

8. The transformable modular toy element according to claim 1, further comprising a snap-fit device configured to keep the body portion in the retracted or deployed position.

9. The transformable modular toy element according to claim 1, wherein the one or more coupling members include a first stud or a first cavity to frictionally engage a second stud or a second cavity of the plurality of modular toy elements of the toy construction system.

10. The transformable modular toy element according to claim 1, wherein the one or more coupling members is arranged at a distal end of the body portion as seen in the axial direction thereof.

11. A transformable modular toy element comprising:

a figurine body portion having a coupling member on a base thereof, and a shell portion attached to the figurine body portion and having a cavity, the cavity having inner guide surfaces configured to guide axial movement of the figurine body portion, wherein:

in a deployed position, the figurine body portion is at least partially axially separated from the shell portion, in a retracted position, the figurine body portion is at least partially axially concealed in the cavity of the shell portion, and the transformable modular toy element further comprises a snap-fit device configured to keep the figurine body portion locked in the deployed position.

12. The transformable modular toy element according to claim 11, wherein the figurine body portion or the cavity of the shell portion defines radially projecting lugs, the other one of the figurine body portion or the cavity defining recesses, the radially projecting lugs and the recesses configured to interact to lock axial movement of the figurine body portion.

13. The transformable modular toy element according to claim 11, wherein the figurine body portion or the cavity of the shell portion defines radially protruding noses, the other one of the figurine body portion or the cavity defining guide channels, the radially protruding noses and the guide channels configured to interact to lock radial rotation of the figurine body portion.

14. A transformable modular toy element for use in a toy construction system comprising a plurality of modular toy elements, wherein the transformable modular toy element comprises:

a body portion comprising one or more coupling members, the one or more coupling members being configured for releasably coupling the body portion with the plurality of modular toy elements of the toy construction system; and a head portion attached to the body portion, the head portion comprising a cavity for receiving the body portion therein, wherein:

the body portion is moveable with respect to the head portion between a retracted position, wherein the body portion is retracted into the cavity, and a deployed position, wherein the body portion is deployed from the cavity, the transformable modular toy element is configured to have a first or a second shape based on the retracted position and deployed position respectively, the second shape extended in an axial direction relative to the first shape, and the body portion is configured to lock relative to the head portion in the deployed position, preventing transformation of the transformable modular toy element from the second shape to the first shape when connecting the transformable modular toy element to a modular toy element of the toy construction system.

* * * * *